United States Patent [19]

Biersack

[11] 4,360,166

[45] Nov. 23, 1982

[54] MOTOR-DRIVEN SHREDDING APPARATUS PARTICULARLY FOR GARDEN WASTE

[75] Inventor: Horst Biersack, Sachsen, Fed. Rep. of Germany

[73] Assignee: Firma Cornes & Co. OHG, Ansbach, Fed. Rep. of Germany

[21] Appl. No.: 179,378

[22] Filed: Aug. 18, 1980

[30] Foreign Application Priority Data

Aug. 29, 1979 [DE] Fed. Rep. of Germany ..... 2934792

[51] Int. Cl.[3] ..... B02C 18/12

[52] U.S. Cl. ..... 241/92; 144/176; 241/101.7; 241/152 A

[58] Field of Search ..... 241/92, 101 D, 101.4, 241/101.7, 152 A; 144/176

[56] References Cited

U.S. PATENT DOCUMENTS

| | | | |
|---|---|---|---|
| 2,191,397 | 11/1939 | Everett | 241/101 D UX |
| 3,817,462 | 6/1974 | Hamlin | 241/101.7 |
| 3,861,602 | 1/1975 | Smith | 241/101.7 X |
| 3,870,239 | 3/1975 | Lautzenheiser et al. | 241/101.7 X |
| 4,047,670 | 9/1977 | Svensson | 241/92 |
| 4,155,384 | 5/1979 | Svensson | 241/92 X |
| 4,159,083 | 6/1979 | Lapointe | 241/92 X |

FOREIGN PATENT DOCUMENTS 2158778 6/1972 Fed. Rep. of Germany .

7826061 9/1978 Fed. Rep. of Germany .

*Primary Examiner*—Howard N. Goldberg

*Attorney, Agent, or Firm*—Neuman, Williams, Anderson & Olson

[57] ABSTRACT

Motor-driven shredding apparatus for garden waste consists of a cutter support plate (13) rotating about a vertical axis in a cutter housing (4) provided with an outlet channel (4''), which plate (13) includes outlet slots (13') and plane-blade-like shredding cutters (14) thereabove. Above the cutter housing (4), two inlets (1,2) are provided for the separate supply of light and heavy material to be shredded, such as thin twigs and leaves and thicker twigs and branches respectively, wherein the inlet (2) for the heavy material to be shredded extends to the shredding cutters (14) and the other inlet (1) lies above shredding blades (17) rotating with the cutter support plate (13). In order to achieve a more effective shredding and blockage-free discharge even of light material to be shredded with a lower power rating, the shredding blades (17) are secured centrally to the upper side of the cutter support plate (13) and project into the lower end of a charging container (3) arranged over the cutter housing (4) and provided with fixed counter-plates (8), which container (3) carries at the top the inlet (1) for the light material to be shredded and below is closed by the cutter support plate (13) and also is equipped with the other, inclined inlet (2) formed as the inlet tube for branches.

8 Claims, 6 Drawing Figures

MOTOR-DRIVEN SHREDDING APPARATUS PARTICULARLY FOR GARDEN WASTE

DESCRIPTION

Background of the Invention

The invention relates to a motor-driven shredding apparatus for waste material, particularly garden waste, which is provided with a cutter housing arranged on a frame carrying the driving motor and including a laterally-discharging outlet channel, in which housing a driven cutter support plate rotating about a centrally-arranged vertical axis is located, which plate is provided with radially-directed outlet slots and, spaced above them, plane-blade-like shredding cutters, wherein further two inlets are arranged above the cutter housing for the separate supply of light and heavy material to be shredded, for example thin twigs and leaves on the one hand and thicker twigs and branches on the other, the inlet for the heavy material to be shredded extending in a downwardly-inclined manner towards the path of rotation of the shredding cutters and the inlet for the light material to be shredded being arranged above the path of rotation of shredding blades connected with the cutter support plate.

In a shredding apparatus of the above kind known from DE-OS No. 2158778, which permits heavy material to be shredded, e.g. thicker twigs and branches, by the rotating cutter support plate with which it is equipped, so as to be finely chopped down and thus effectively shredded, the shredding blades are formed as impact blades rotatably hinged on the outer circumferance of the cutter support plate, which impact blades grind or tear the thinner twigs, leaves or foliage separately supplied to them and pass this material directly into the laterally-discharging outlet channel located therebelow. This impact blade apparatus needs a spacious cutter housing, however, leads to the undesirable production of noise and also necessitates a relatively high weight and throughput consumption, so that such a shredding apparatus requires supporting rollers for movement as well as a motor of a higher power loading amounting to at least several kilowatts. The material being shredded can become partly involved in the rotary movement of the impact blades, so that it is merely torn into more or less long strips or is even merely bent about. In this way, its further transit into and through the outlet channel is correspondingly hindered, so that blockages not infrequently occur.

Furthermore, a shredding apparatus for garden waste is known from DE-GM No. 7826161, which is provided with a cylindrical charging container including only one inlet and a cutter shaft arranged thereunder and extending along the container axis, which shaft is equipped with successively downwardly-mounted preshredding blades, shredding cutters and discharge blades, as well as being rotationally driven by a frame-supported electric motor and wherein furthermore a laterally discharging outlet channel located at the level of the discharge blades is provided. Since here the shredding cutter rotates in a freely moving manner in the lower part of the charging container, but not very far above the base of the container, again the material fed in to be shredded is only cut into more or less long strips or is torn or even only bent about, the material to be shredded can readily become caught up in the circulating movement of the rotating shredding cutter. This leads to an irregular intermittent shredding action, which thus requires a correspondingly larger power loading, particularly if bigger branches are included in the material to be shredded, which cannot be chopped or sliced up in this way, and particularly to considerable stresses, reducing the likely service life of this apparatus and also to frequent shut-downs.

SUMMARY OF THE INVENTION

The invention is based upon the purpose of providing a shredding apparatus, intended particularly for garden waste, of the kind mentioned initially, thus having separate inlets for light and heavy material to be shredded and a cutter support plate for chopping up the latter material, which apparatus is of low weight and low power loading and which produces an effective and fine comminution of the light waste material to be shredded and is thus manufactured without an expensive impact blade mechanism. This purpose is solved in accordance with the invention, on the basis of a shredding apparatus of the kind in question, in that the shredding blades are secured centrally to the upper side of the cutter support plate and extend in an upwardly and outwardly inclined manner into the lower end of a cylindrical charging container arranged above the cutter housing and provided with internal annularly-arranged counter-plates extending into the vicinity of the path of rotation of the shredding cutter and the shredding blades, which container carries at the top the inlet for the light material to be shredded and is closed downwardly by the cutter support plate provided on its lower side with discharge blades and serving as its base and also provided through its lower wall part with the other, downwardly-inclined inlet formed as an inlet tube for branches. In this way, a shredding apparatus is provided, in which not only the heavy material to be shredded, to be supplied via the inlet tube for branches, but also the light material to be shredded, to be supplied via the charging container or its upper inlet, after passing through the shredding blades rotating in front of the counter-plates and undergoing the resultant pre-shredding, must then plass through the rotating cutter support plate, thereby becoming finely comminuted, and is then discharged into the outlet channel by means of the discharge blades provided on the underside of the cutter support plate, without blockages occurring. The shredding apparatus thus works satisfactorily and is practically free from stoppages, so that with a relatively small motor power a high shredding rate can readily be attained. Advantageously, the shredding blades are formed from the inclined outwardly-angled limbs of a U-shaped member, rotating adjacent the uppermost part of the inlet tube for branches and the fixed counter-plates, which lies with its central web flat against the cutter support plate and is secured non-rotatably to the upper end of a cutter shaft carrying the latter.

The passageway provided at the lower end of the inlet for the light material to be shredded is advantageously made in slot form and is not wider than 3 cm. In this way, not only does this prevent the operator from reaching with his hands into the charging container and from being able to reach into the path of rotation of the pre-shredding blades, but also this ensures that any stalk-like material to be shredded is prevented by the slot-like opening from going round with the rotating shredding blades, whereby the shredding capacity is further improved. In this connection, the stationary counter-plates fixedly arranged in the charging container beneath the shredding blades and also the inlet or supply tube for branches also contribute to this, as such tube and the counter-plates serve to cooperate not only with the shredding cutters of the cutter support plate, but also with the shredding blades.

The shredding cutters are advantageously constructed as double-sided ground adjustable reversible cutter plates, so that their useful duration is considerably extended.

DETAILED DESCRIPTION OF PREFERRED EMBODIMENT

Figure 1:
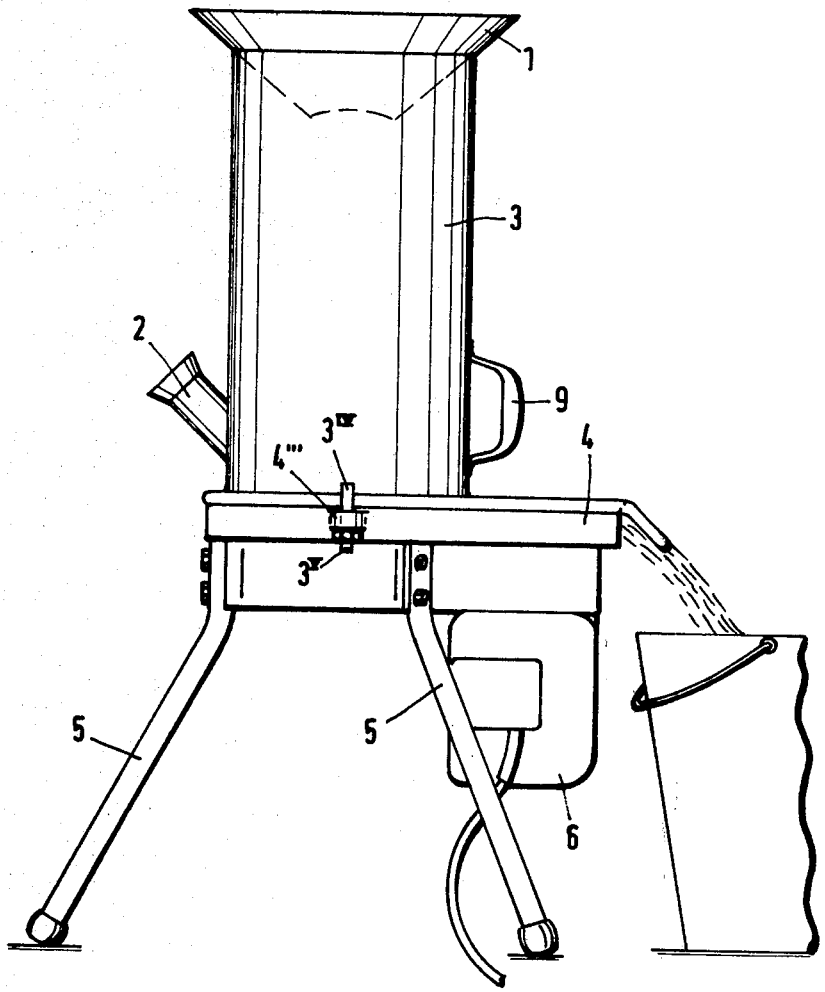

Further features of the invention are characterised in the sub-claims.

Figure 2:
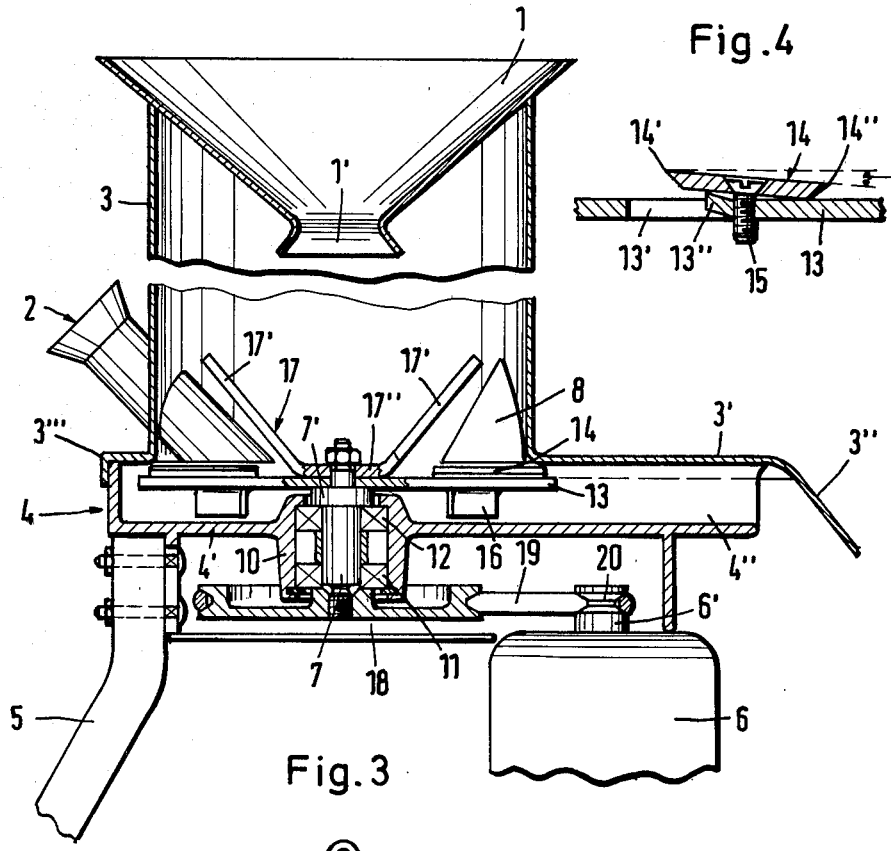
Figure 4:
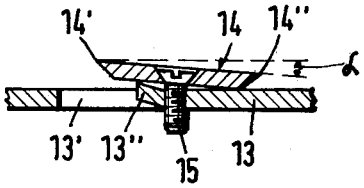
Figure 3:
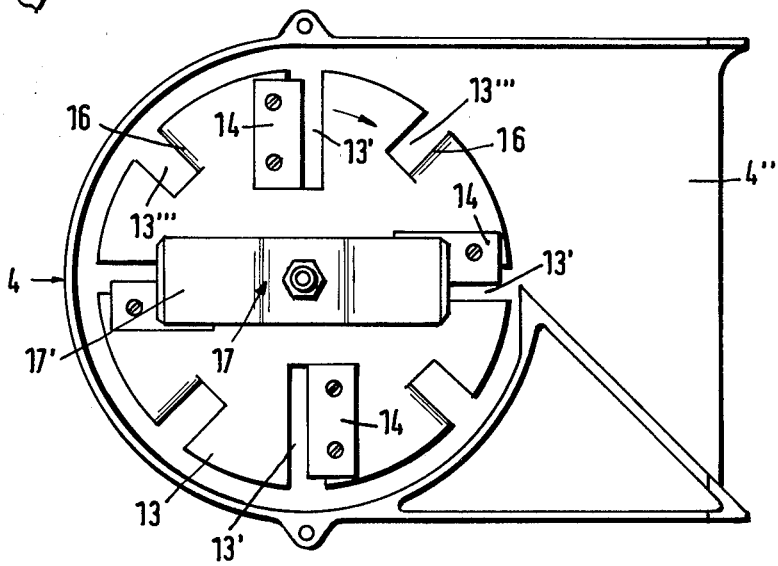
Figure 5:
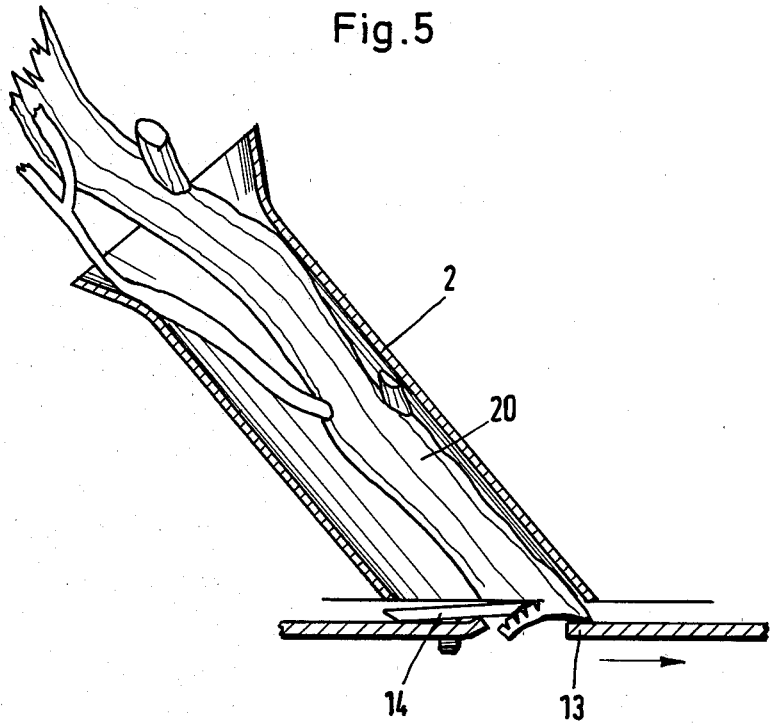
Figure 6:
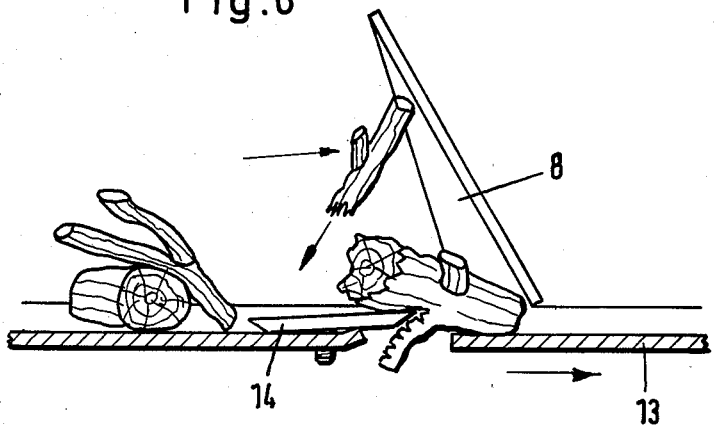

In the drawing, an advantageous embodiment of the invention is illustrated. These show:

FIG. 1—the shredding container in side view;

FIG. 2 a vertical section through the shredding container;

FIG. 3—a plan view of the cutter housing with the charging container removed; and FIG. 4—an enlarged representation of the cutter mounting on the cutter support plate, whereas FIGS. 5 and 6—the mode of operation of the shredding cutters.

The shredding apparatus, intended mainly for garden waste, illustrated in FIG. 1 consists essentially of a cylindrical charging container 3 provided with a hopper-like inlet 1 and a supply tube 2, for branches and heavier waste generally, and a detachably connectible cutter housing 4 with frame support legs 5 and an electric motor 6 secured thereto, which motor serves to drive a cutter shaft 7 mounted in a cutter base 4' and provided with shredding mechanism.

The charging container 3, preferably consisting of 1.5 mm guage plastics-coated steel sheet, is rigidly connected with the inlet 1, whose inlet opening 1' is made slot-shaped according to FIG. 2, the width of the slot amounting to about 3 cm, so that the operator is prevented from reaching into the charging container 3 with his hands and from being able to reach into the path of rotation of the shredding mechanism. The supply tube 2 for branches provided in the charging container 3 is inclined from the exterior inwardly through the container wall and is rigidly connected thereto. Furthermore, inside the lower part of the charging container 3, several correspondingly-arranged circumferential stationary counter-plates 8 are provided. Finally, the charging container 3 is provided below with a laterally-discharging covering hood 3', which leads externally to a downwardly-inclined angled outlet flap 3''.

The cutter housing 4, as shown particularly in FIG. 3, is of substantially U-shaped form. It consists of a laterally-discharging outlet channel 4'', which is covered by the hood 3' of the charging container 3. As FIG. 2 shows, the charging container 3 with its covering hood 3' and its lower peripheral rim 3''' is placed on the cutter housing 4 and is detachably connected to it, for example by means of supporting screws $3^{IV}$ arranged downwardly on the container 3 and, as shown in FIG. 1, passing through supporting lugs 4''' provided on the cutter housing 4 and carrying fixing nuts $3^{V}$. Furthermore, a carrying handle 9 is provided on the charging container 3 and preferably is located in the vicinity of the centre of gravity of the shredding apparatus, so that the latter is thus easy to carry.

In the base 4' of the cutter housing 4, according to FIG. 2, a bearing housing 10 is formed, in which the cutter shaft 7 is mounted by means of ball bearings 11,12, on the prolongation of the container axis. The cutter shaft 7 is provided with a flange 7', on which a cutter support plate 13 is fixedly located, the plate 13 simultaneously forming the base of the charging container 3. On the cutter support plate 13, shredding cutters 14 are located above radially-directed outlet slots 13' arranged in it. As FIG. 4 shows, these cutters 14 consist of double-sided reversible sharpened cutter plates, which, after corresponding use of one cutting edge 14', can be turned round so that the other cutting edge 14'' is brought into the operative position. Attachment of the shredding cutters or reversible cutting plates 14 is preferably effected by means of securing screws 15, which in conjunction with the slightly upwardly-angled edge 13'' of each of the slots 13' in the cutter support plate 13 allow the shredding cutters 14 to be held at a pre-determined setting angle $\alpha$ with respect to the support plate 13. In this way, the operative cutting edges 14' of the shredding cutters 14 are fixed at a pre-determined distance from the surface of the cutter support plate 13, so that a pre-determined chopping depth is given in conjunction with the plane-like shredding or comminuting action of the cutters 14. Preferably, in a manner not illustrated, for example by means of corresponding longitudinal slots, the cutters 14 are secured to the cutter support plate 13 in an adjustable manner, so that the cutting thickness can be varied. At the underside of the cutter support plate 13, discharge blades 16 are arranged, which are formed from dependent stamped lugs left on the cutter support plate on forming additional radial slots 13'''. These angled stamped lugs 16 project close to the base 4' of the cutter housing 4 and thus ensure an effective discharge effect.

Above the cutter support plate 13, a pre-shredder 17 is also mounted on the cutter shaft 7, consisting of a U-shaped metal member having inclined outwardly angled limbs 17' which form two pre-shredder blades, whereas the central web 17'' of the U-shaped member 17 lies flat on the cutter support plate 13 and is fixedly connected to the shaft 7. The pre-shredder blades 17' are so inclined that they rotate closely above the supply tube 2 for branches and the fixed counter-plates 8, so that the latter serve as cooperating members, not only for the shredding cutters 14, but also for the pre-shredding blades 17'.

On its lower end projecting out from the bearing 10 of the cutter housing base 4', a belt pulley 18 is secured to the cutter shaft 7 and is driven by means of a pulley belt 19 from a smaller pulley wheel 20 located on the motor shaft 6'. As the motor, a 220-volt AC motor of 750 watts output is preferably used.

The generally coarse garden waste material supplied to the charging container 3 via the inlet 1 is prevented by the entry slot 1' from being rotated by means of the pre-shredding blades 17', so that it can effectively be coarsely chopped or pre-shredded by the rotating blades 17'. The inclined fixed plates 8 guide the thus pre-shredded material to the cutter support plate 13 and thus to the shredding cutters 14 located on its upper surface, whereby the waste material is sliced or planed down until it passes through the outlet slots 13' and 13''' and is then thrown out laterally by the discharge blades 16 through the outlet channel 4'' and is then discharged downwardly. The substantially uniform plane-like shredding action also occurs, in particular with coarser branch-like material, which is pushed laterally into the inlet tube 2 and then chopped up or sliced by the shredding cutters 14 in the manner shown in FIG. 5. Since in this case only chips or pieces of relatively small thickness are chopped or planed off from the thick branch material 20, the shredding work thus effected is relatively light, and thus is the more even, so that use can be made of a smaller motor power. Thus, the shredding apparatus can save on both weight and cost and also it can be handled extremely easily, so that it can be readily taken by means of the carrying handle 9 to any desired location where there is a larger supply of waste material to be shredded. Because of the fine shredding of the garden waste, this can be used directly for the mulching of beds and borders or beneath trees and also can be readily hoed or raked in, so that an inexpensive and satisfactory biological fertilization of the ground can be achieved.

I claim:

1. Motor-driven shredding apparatus for comminuting waste material, particularly garden waste, which comprises a cutter housing having a laterally-directed outlet for the discharge of shredded waste material, a cutter support plate mounted within the cutter housing for rotation about a central vertical axis, a frame supporting the cutter housing and carrying a motor for rotatably driving the cutter support plate, respective inlets arranged above the cutter housing and serving to direct light material to be shredded and heavy material to be shredded separately towards the cutter support plate, at least one radial slot in the cutter support plate, a shredding cutter mounted upon the cutter support plate above each radial slot and cooperating therewith on rotation of the cutter support plate to shred waste material and direct the shredded material downwardly through the cutter support plate, a cylindrical charging container for receiving waste material to be shredded located over the cutter housing, the cutter support plate being positioned so as to form the base of the container, at least one shredding blade mounted on the upper side of the cutter support plate for rotation therewith and extending upwardly and in an outwardly-inclined manner relative to the central vertical axis into the charging container, at least one fixed counter-plate located within the container for cooperating with each shredding cutter and also with each shredding blade and positioned so that the path of rotation of each shredding cutter is below and adjacent each fixed counter-plate and so that the path of rotation of each shredding blade is above and adjacent each fixed counter-plate, the inlet for light material to be shredded being located at the top of the container and the inlet for heavy material to be shredded comprising a downwardly-inclined inlet tube passing through the lower wall part of the container to discharge above the cutter support plate and at least one dependent discharge blade on the cutter support plate for directing shredded waste toward the laterally-directed outlet.

2. Shredding apparatus according to claim 1, wherein two shredding blades are provided in the form of oppositely outwardly and upwardly inclined limbs of a U-shaped member rotatable adjacent the fixed counter-plates, a cutter shaft mounted for rotation about the central vertical axis is drivingly coupled to the motor and a central web of the U-shaped member is located against the upper side of the cutter support plate and is secured together with the cutter support plate to the top of the cutter shaft.

3. Shredding apparatus according to claim 2, wherein bearings for mounting the cutter shaft are located in the base of the cutter housing, such housing is of U-shape in plan, the charging container is located on and detachably connected to the cutter housing, a laterally-directed discharge hood is provided over the discharge channel extending from the cutter housing and a downwardly-inclined flap is provided on the outlet each of the discharge channel.

4. Shredding apparatus according to claim 1, wherein the discharge blades comprise dependent lugs formed by stamping additional radial slots in the cutter support plate.

5. Shredding apparatus according to claim 1, wherein the inlet aperture for light material to be shredded comprises a slot not more than 3 cm in width at the lower end of a hopper-like inlet provided at the top of the charging container.

6. Shredding apparatus according to claim 1, wherein the shredding cutter comprises a double-edged cutter plate reversibly mountable over its associated radial slot, whereby one of the cutting edges of the cutter plate can be positioned for effecting the shredding of waste material.

7. Shredding apparatus according to claim 1, wherein the frame carries support legs for the apparatus and an electric motor for rotating the cutter support plate and the components mounted thereon is mounted underneath the cutter housing.

8. Shredding apparatus according to claim 1, wherein a carrying handle for the apparatus is attached to the charging container adjacent the centre of gravity of the apparatus.

* * * * *